United States Patent [19]

Martin

[11] 4,023,316

[45] May 17, 1977

[54] STORAGE MEANS FOR ASHES FROM CREMATIONS

[76] Inventor: Peter D. Martin, 78 Ayton Ave., Fulham, Australia, 5024

[22] Filed: July 7, 1976

[21] Appl. No.: 703,132

[52] U.S. Cl. ..... 52/100; 52/137; 52/139

[51] Int. Cl.[2] ..... E04H 13/00

[58] Field of Search ..... 52/136, 137, 139, 98, 52/100; 27/1

[56] References Cited

UNITED STATES PATENTS

| | | | |
|---|---|---|---|
| 3,543,457 | 12/1970 | Budlong | 52/100 |
| 3,925,944 | 12/1975 | Pickel | 52/136 X |

FOREIGN PATENTS OR APPLICATIONS

| | | | |
|---|---|---|---|
| 498,192 | 1/1951 | Belgium | 52/136 |

*Primary Examiner*—Price C. Faw, Jr.
*Assistant Examiner*—Carl D. Friedman
*Attorney, Agent, or Firm*—McNenny, Pearne, Gordon, Gail, Dickinson & Schiller

[57] ABSTRACT

An arrangement for holding cremation ashes in which the apertures into which the ashes are to be placed are preformed and are positioned so as to leave a front decorative face unbroken until needed whereupon the face can be broken so as to gain access to the aperture and very quickly thereafter be covered by a commemorative plaque.

5 Claims, 5 Drawing Figures

STORAGE MEANS FOR ASHES FROM CREMATIONS

This invention relates to an arrangement for the storage of ashes the result of human or other cremations.

BACKGROUND OF INVENTION

It is presently a common practice that storage of cremation ashes is by location of these between baked clay bricks erected in an interlocking relationship leaving however crevices therebetween.

These crevices which are in the form therefore of rectangular niches are left open and as these are required, a suitable commemoration plaque is placed to close the outer face of the particular niche thus sealing this.

It has been found that building such a wall can be expensive and, because the wall is usually painted, constant maintenance is required to keep the pleasant appearance of the wall.

Furthermore, some mourners become distressed upon seeing the open niches and this is also considered a disadvantage of the common method.

OBJECT OF THIS INVENTION

This invention proposes an arrangement by which at least some of the above problems can be at least reduced.

STATEMENT OF INVENTION

This invention can be said to reside in an arrangement for holding cremation ashes including a support member having a decorative outer upright face and, within the support member behind and leaving unbroken the decorative face, a plurality of spaced apart parallel apertures opening into an oppositely positioned face from the decorative face arranged so that by pressure applied against the front of the decorative face, this can be broken to the extent so as to leave a forward opening to a selected aperture so that cremation ashes can be located therein and a commemorative plaque secured to close the said forward opening.

According to a preferred arrangement, the support member is a stone slab, and the plurlity of apertures are, in each case, shaped as a slot of constant annular cross section.

In another preferred arrangement, the support member includes at least a backing portion which is of cast concrete.

It will be appreciated with this last preferred feature that for the sake of cost saving, the stone slab or decorative face need not extend the full thickness that is required for any of the apertures whereby to adequately hold the ashes or more importantly to provide adequate strength for the decorative face and in this case a material, perhaps cast concrete or other masonry cast material could be used.

An advantage in using an integral stone slab in which a number of apertures are in the form of annular slots of constant cross section, is the fact that the stone slab can be drilled in a manner using a hollow core diamond drill which is then held in an appropriately located jig and arranged so that the plurality of regularly shaped apertures can be drilled from the rough side of the slab to a distance approaching the decorative face which will not unduly weaken the portion of stone at the decorative face but at the same time will allow sufficiently reduced strength to enable a ready breaking of the decorative face and to enable a relatively simple cleaning around the perimeter edge of the opening of the aperture into the decorative face.

According to a further preferred arrangement, there are provided two stone slabs each being integral and each slab being of similar dimension to the other and positioned one relative to the other so that these are positioned back to back with oppositely outwardly facing decorative faces.

It will be appreciated that access to the open apertures from the rear face of any stone slab is not preferred and furthermore such faces are in a rough state so it would normally be desired that these be hidden from view.

A most appropriate way of achieving this is to provide that there are two separate stone slabs arranged back to back so that the structure then becomes a self standing structure and by appropriately cladding both the ends and the top, the structure can be of good appearance and the only external viewing faces are either the continuous unbroken decorative faces or commemorative plaques where the apertures have been broken into.

DESCRIPTION OF PREFERRED EMBODIMENT

Figure 1:
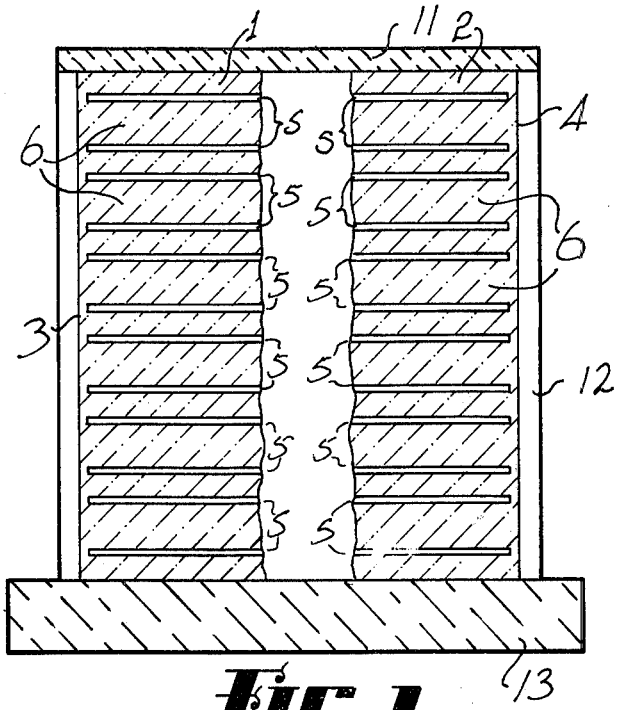
Figure 2:
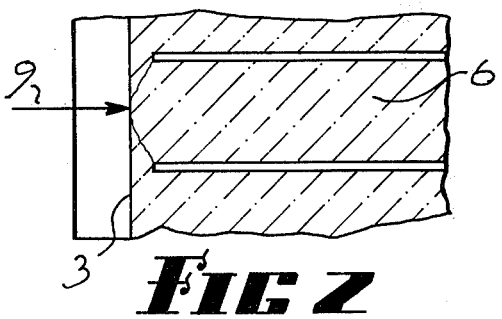
Figure 3:
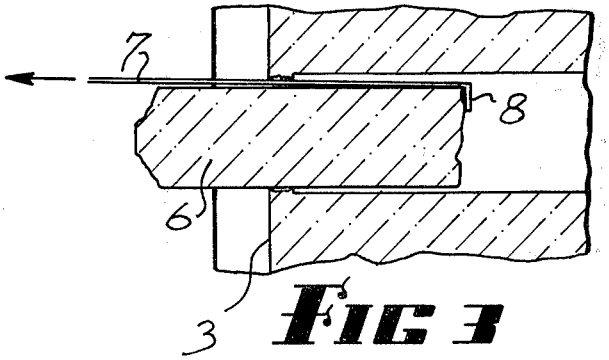
Figure 4:
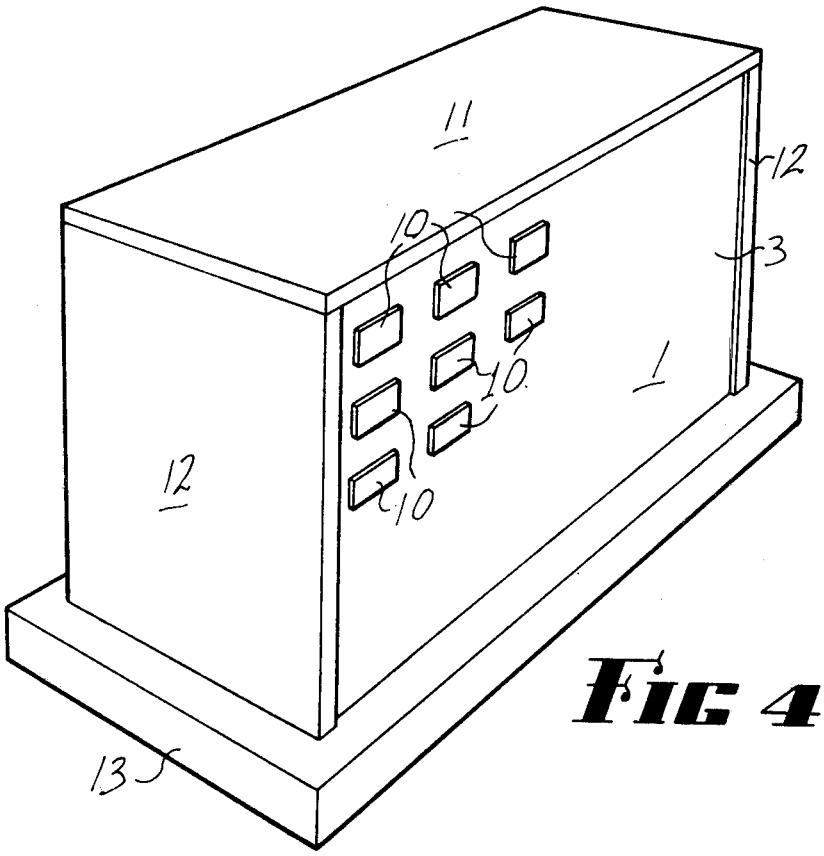
Figure 5:
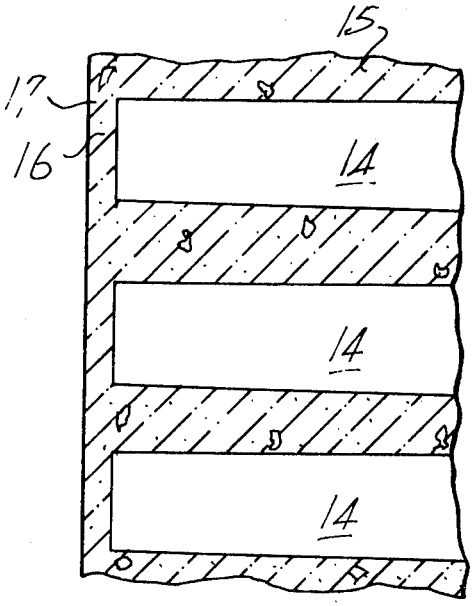

This invention shall now be described with reference to a preferred embodiment with the assistance of drawings in which, FIG. 1 is a cross sectional view of an arrangement according to the first embodiment, FIG. 2 illustrates in enlarged detail, the method by which a decorative face when under impact at the centre of the axis of the annular slot, will effect a break which will not extend to cracking into the further portions of the decorative face, FIG. 3 illustrates how the core once broken can be removed, FIG. 4 illustrates an external visual view of the embodiment that is shown in cross section in FIG. 1 in this instance however there being shown some commemorative plaques and, FIG. 5 illustrates in cross section the manner in which a second embodiment made from cast concrete would be made and enable the concept of this invention to be put into effect.

Referring in detail to FIG. 1, there are accordingly two stone slabs 1 and 2 each of these constituting therefore a support member and each of these having a decorative outer upright face 3 and 4.

Located within each of the slabs 1 and 2 and located behind and therefore leaving unbroken the decorative face 3 or 4, an annular slot 5 this being of constant cross sectional shape throughout the length and indeed the forming of this slot is achieved by drilling with a hollow core diamond drill from the rear side of the slab.

It will be noticed that each of the slots is of a common position from the decorative face either 3 or 4 and this is achieved by carefully measuring the distance the drill works into the stone slab so as to make sure that there is sufficient strength to hold the remaining core 6 supported so that this will not accidentally fracture the decorative face either 3 or 4.

Likewise it must be of small enough size so that there can be readily caused a fracture such as is shown in FIG. 2 that is an internally opening conical shape which ensures that the edges of the annular slot as remain then of the cylindrical space are relatively clean.

Removal of a core once broken away and the edges around the external perimeter being chipped away by a suitable chipping tool, can be removed by insertion of a device such as shown at 7 which has a flexible tip 8 which can be pushed in behind the core and this can then be removed.

It will be clear that the location of any aperture can be achieved by a comparison of the measurements of the location of the holes relative to the back as compared to the position of the front decorative face.

Each of the holes will be drilled so that they are exactly perpendicular to the decorative face and it is then simply a matter of measurement so as to readily locate the centre point of the aperture or the axial point as shown for instance in FIG. 2 by the arrow 9.

The location of each of the axial points of the aperture can be achieved in other ways for instance by the use of a jig in which each of the axial points is marked by an aperture through a sheet of board.

In any event, it will be seen that location of this particular point will be no difficulty for those who are aware of the pattern of distribution but it will not be readily apparent to vandals that the frontal face is susceptible to this type of impact so as to open into each of the apertures.

Furthermore the decorative face will at all times present a closed face to any viewer so that there will only be necessarily, a commemorative plaque or a plain decorative face presented to any mourner.

This is shown most clearly in FIG. 4 where there is an illustrative arrangement showing the commemorative plaque 10 positioned over open apertures.

Otherwise the decorative frontal face 3 is unbroken.

It will be seen that the stone slabs 1 and 2 are surrounded by the decorative cladding material there being an upper sheet of marble 11 and side sheet 12.

The whole is located on a base member 13.

This then describes the first preferred embodiment which is the desirable method by which the invention can be carried out.

However the drilling into a high quality marble slab, may be considered by some to be an expensive process and there is also the preparation necessary for a decorative frontal face that is the face must be polished and the various sheets of cladding must be prepared suitably and therefore while being a very long lasting monument and an arrangement for holding cremation ashes, there are other means by which the invention can be carried out which are perhaps slightly cheaper.

FIG. 5 illustrates one manner of otherwise carrying out the invention which includes having apertures 14 which are cast so as to have an open end into a rear face of a slab the whole of a slab being a moulded slab from a masonry material such as concrete and each of the apertures 14 within the cast concrete slab 15 terminating so as to leave an adequate thickness at 16 between a decorative face 17 and the aperture 14.

The means by which a decorative face 17 can be achieved using a cast concrete backing is common to the art and need not be described in detail in this specification. Such methods as using fine coloured stones in the masonry mix. This face can be then polished in traditional manner.

There is the advantage with respect to the arrangement as shown in FIG. 5 in that the cross sectional shape of each aperture need not be circular and indeed the cross sectional shape need not be constant along the length and indeed it is preferred that there be a taper so as to remove any moulding device by which to form the aperture 14.

It will now be seen that the invention in its widest concept provides an arrangement which has substantial advantage and which can enable an arrangement for storage of cremation ashes to be made which is both economical and can be long lasting with minimal maintenance.

What is claimed is:

1. An arrangement for holding cremation ashes including a support member having a decorative outer upright face and, within the support member behind and leaving unbroken the decorative face, a plurality of spaced apart parallel apertures opening into a face opposite the decorative face and arranged so that by pressure applied against the front of the decorative face, this decorative face can be broken to the extent so as to leave an opening to the selected aperture so that cremation ashes can be located therein and a commemorative plaque secured to close the said opening into the selected aperture.

2. An arrangement for holding cremation ashes as in claim 1 wherein the support member is a stone slab, and the plurality of apertures are, in each case, shaped as a slot of constant annular cross section.

3. An arrangment for holding cremation ashes as in claim 1 wherein the support member includes backing portion of cast concrete.

4. An arrangement for holding cremation ashes as in claim 2 in which there are two slabs, each slab is of similar dimension to the other and positioned one relative to the other so that they are positioned back to back with oppositely outwardly facing decorative faces.

5. An arrangement for holding cremation ashes as in claim 3 in which the apertures are formed by moulding within the cast concrete.

* * * * *